US007628283B2

(12) United States Patent
Shingle

(10) Patent No.: US 7,628,283 B2
(45) Date of Patent: Dec. 8, 2009

(54) TAMPER-INDICATING CHILD-RESISTANT PACKAGE

(75) Inventor: John M. Shingle, Perrysburg, OH (US)

(73) Assignee: Rexam Prescription Products Inc., Perrysbugh, OH (US)

( * ) Notice: Subject to any disclaimer, the term of this patent is extended or adjusted under 35 U.S.C. 154(b) by 348 days.

(21) Appl. No.: 11/653,749

(22) Filed: Jan. 16, 2007

(65) Prior Publication Data

US 2008/0169263 A1 Jul. 17, 2008

(51) Int. Cl.
*B65D 50/08* (2006.01)
*B65D 50/00* (2006.01)

(52) U.S. Cl. ..... 215/209; 215/44; 215/47; 215/216; 215/256; 220/276

(58) Field of Classification Search ..... 215/221, 215/254–256, 901, 43–45, 47, 209, 216, 215/217, 273; 220/276, 315
See application file for complete search history.

(56) References Cited

U.S. PATENT DOCUMENTS 2,521,098 A * 9/1950 Sebell ..... 220/276
2,532,729 A * 12/1950 Millstein ..... 446/73
3,716,162 A 2/1973 Botkin
3,744,655 A * 7/1973 Nixdorf, Jr. ..... 215/216
3,837,518 A 9/1974 Gach
3,841,512 A * 10/1974 Botkin ..... 215/365
3,945,525 A * 3/1976 Jones ..... 215/232
3,989,152 A * 11/1976 Julian ..... 215/216
4,024,976 A 5/1977 Acton
4,036,385 A * 7/1977 Morris ..... 215/209
4,099,639 A * 7/1978 Boxer et al. ..... 215/209
4,103,797 A * 8/1978 Morris ..... 215/209
4,320,843 A * 3/1982 Dubach ..... 215/256
4,326,649 A * 4/1982 Marino et al. ..... 222/182
4,341,318 A * 7/1982 Smalley ..... 215/225
4,457,437 A 7/1984 Heath, Jr.
4,512,485 A * 4/1985 Agbay et al. ..... 215/225

(Continued)

FOREIGN PATENT DOCUMENTS

EP 0770560 A1 5/1997

*Primary Examiner*—Anthony Stashick
*Assistant Examiner*—Ned A Walker
(74) *Attorney, Agent, or Firm*—Reising Ethington PC

(57) ABSTRACT

A tamper-indicating child-resistant package includes a container having a cylindrical finish with at least one external thread segment, a manually deflectable release element externally cantilevered from the finish, and a tear band frangibly connected to the finish and having an upstanding locking lug. A closure has a skirt with at least one internal thread segment for mating engagement with the external thread segment on the container finish, a first lock element on the skirt for engagement with the manually deflectable release element and second lock element on the skirt for engagement with the locking lug on the tear band. Engagement between the second lock element on the closure skirt and the locking lug on the tear band prevents unthreading of the closure from the container finish until the tear band is frangibly removed from the finish, whereupon deflection of the manually deflectable release element releases the closure for unthreading from the finish. The tear band preferably extends in a plane partway around the finish and has ends adjacent to the release element. The tear band preferably is frangibly connected to the finish by angularly spaced frangible bridges.

6 Claims, 2 Drawing Sheets

U.S. PATENT DOCUMENTS 4,522,307 A 6/1985 Steiner
4,527,702 A * 7/1985 Heath, Jr. ..... 215/225
4,534,481 A * 8/1985 Summers et al. ..... 215/253
4,555,042 A * 11/1985 Rathbun ..... 220/277
4,573,598 A * 3/1986 Perry ..... 215/204
4,573,599 A * 3/1986 Fillmore ..... 215/225
4,646,926 A 3/1987 Agbay et al.
4,671,420 A * 6/1987 Marcus ..... 215/44
4,711,364 A * 12/1987 Letica ..... 220/276
4,752,014 A * 6/1988 House et al. ..... 215/216
4,852,751 A 8/1989 Halfacre
4,854,459 A * 8/1989 DeJonge ..... 215/220
4,948,002 A * 8/1990 Thornock et al. ..... 215/221
4,993,570 A 2/1991 Julian et al.
5,027,969 A * 7/1991 Lesquir ..... 220/270
5,052,574 A * 10/1991 McKinnon et al. ..... 220/276
5,165,559 A * 11/1992 Kusz ..... 215/216
5,170,905 A * 12/1992 Luch ..... 220/276
5,249,694 A * 10/1993 Nelson ..... 220/276
5,307,948 A * 5/1994 Blackburn et al. ..... 220/269
5,413,233 A * 5/1995 Hall ..... 215/209
5,511,677 A 4/1996 Oder
5,544,768 A * 8/1996 Gargione ..... 215/209
5,586,671 A * 12/1996 Thomas et al. ..... 215/209
5,671,853 A * 9/1997 Herr ..... 215/216
5,706,963 A * 1/1998 Gargione ..... 215/219
5,711,442 A * 1/1998 Kusz ..... 215/209
5,735,419 A * 4/1998 Ma ..... 215/253
5,816,422 A * 10/1998 Roig ..... 215/209
5,899,348 A 5/1999 Konefal et al.
5,927,527 A 7/1999 Montgomery et al.
6,039,195 A * 3/2000 Konefal et al. ..... 215/209
6,039,196 A * 3/2000 Ekkert et al. ..... 215/216
6,076,689 A * 6/2000 Vassallo ..... 215/209
6,079,579 A * 6/2000 De Cuyper ..... 215/41
6,168,035 B1 * 1/2001 McLelland ..... 215/216
6,283,318 B1 * 9/2001 Lee ..... 215/254
6,327,770 B1 * 12/2001 Konefal et al. ..... 29/450
6,375,069 B1 * 4/2002 Smith ..... 229/211
6,508,373 B1 * 1/2003 Robinson ..... 215/209
6,814,259 B1 * 11/2004 Foster et al. ..... 222/153.09
7,303,088 B2 * 12/2007 Sawyer et al. ..... 215/237
7,404,495 B2 * 7/2008 Keung ..... 215/237
2005/0103741 A1 * 5/2005 Shingle ..... 215/228
2005/0230342 A1 * 10/2005 Folchini et al. ..... 215/254
2005/0263477 A1 * 12/2005 Konefal et al. ..... 215/228
2006/0070970 A1 * 4/2006 Shingle ..... 215/220
2006/0070973 A1 * 4/2006 Shingle ..... 215/329
2006/0213861 A1 * 9/2006 Konefal et al. ..... 215/222
2006/0249474 A1 * 11/2006 Sawyer et al. ..... 215/256
2006/0255004 A1 * 11/2006 Shingle et al. ..... 215/332
2007/0012645 A1 * 1/2007 Gnepper et al. ..... 215/222
2007/0023380 A1 * 2/2007 Shingle et al. ..... 215/217

* cited by examiner

TAMPER-INDICATING CHILD-RESISTANT PACKAGE

The present disclosure relates to a tamper-indicating child-resistant package and to a container for such a package.

BACKGROUND AND SUMMARY OF THE DISCLOSURE

U.S. Pat. Nos. 5,899,348, 6,039,195 and 6,327,770 disclose child-resistant containers and packages that include a manually deflectable release element cantilevered from the container to prevent unthreading of a closure from the container absent deflection of the release element. Although the containers and packages disclosed in the noted patents have enjoyed substantial commercial acceptance and success, improvements remain desirable. It is particularly desirable, for example, to provide for indication that the package has been opened, thereby evidencing possible tampering with the contents of the package. A general object of the present disclosure is to provide a child-resistant package of the type having a manually deflectable release element to permit unthreading of the closure from the container and including means for indicating that the package has been opened. Another general object of the present disclosure is to provide a container for such a package.

The present disclosure embodies a number of aspects that can be implemented separately from or in combination with each other.

A tamper-indicating child-resistant package, in accordance with one aspect of the present disclosure, includes a container having a cylindrical finish with at least one external thread segment, a manually deflectable release element externally cantilevered from the finish, and a tear band frangibly connected to the finish and having an upstanding locking lug. A closure has a skirt with at least one internal thread segment for mating engagement with the external thread segment on the container finish, a first lock element on the skirt for engagement with the manually deflectable release element and second lock element on the skirt for engagement with the locking lug on the tear band. Engagement between the second lock element on the closure skirt and the locking lug on the tear band prevents unthreading of the closure from the container finish until the tear band is frangibly removed from the finish, whereupon deflection of the manually deflectable release element releases the closure for unthreading from the finish. The tear band preferably extends in a plane partway around the finish and has ends adjacent to the release element. The tear band preferably is frangibly connected to the finish by angularly spaced frangible bridges.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
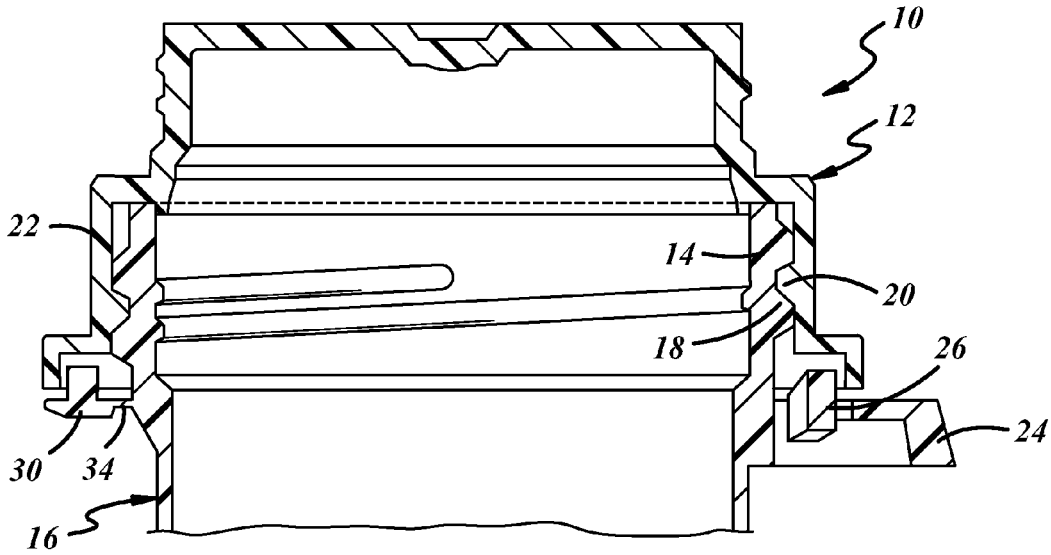
FIG. 1 is a fragmentary sectional view of a tamper-indicating child-resistant package in accordance with an exemplary embodiment of the present disclosure.
Figure 4:
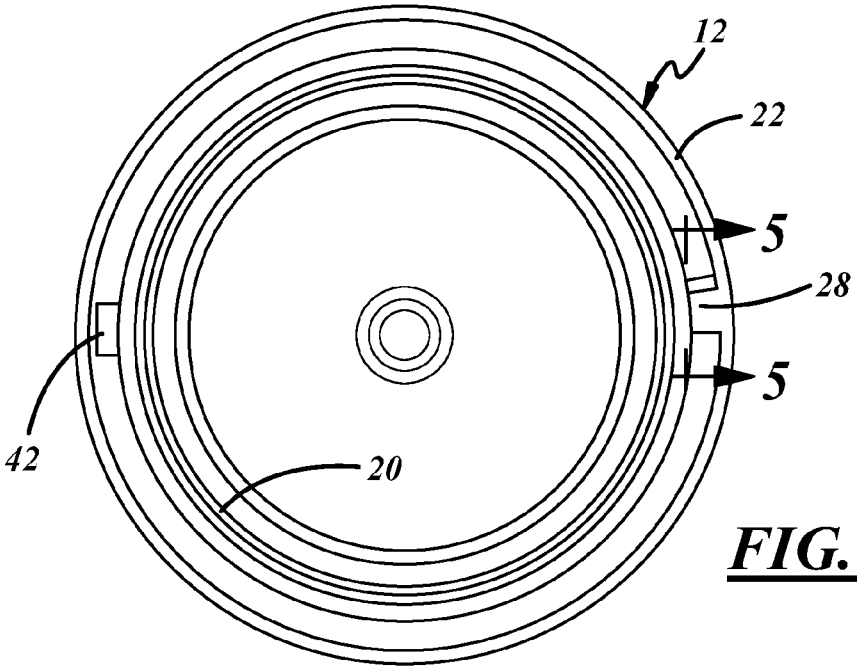
FIG. 4 is a bottom plan view of the closure in the package of FIG. 1.
Figure 5:
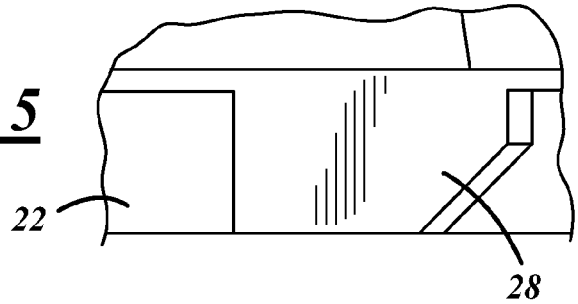
FIG. 5 is a fragmentary sectional view taken substantially along the line 5-5 in FIG. 4.

FIG. 1 illustrates a tamper-indicating child-resistant package 10 in accordance with an exemplary embodiment of the present disclosure as including a closure 12 threaded onto the finish 14 of a container 16. Container finish 14 is cylindrical and has at least one external thread segment 18 that is engaged by at least one internal thread segment 20 on the skirt 22 of closure 12. (The term "thread segment" is employed in its usual broad sense to include continuous or discontinuous threads and single or multiple threads.) A manually deflectable release element 24 is cantilevered from finish 14 beneath thread segment 18. Manually deflectable release element 24 has a locking lug 26 that cooperates with a first lock element 28 (FIGS. 4 and 5) on closure skirt 20 to prevent unthreading of closure 12 from container 16 absent manual deflection of release element 24.

Figure 2:
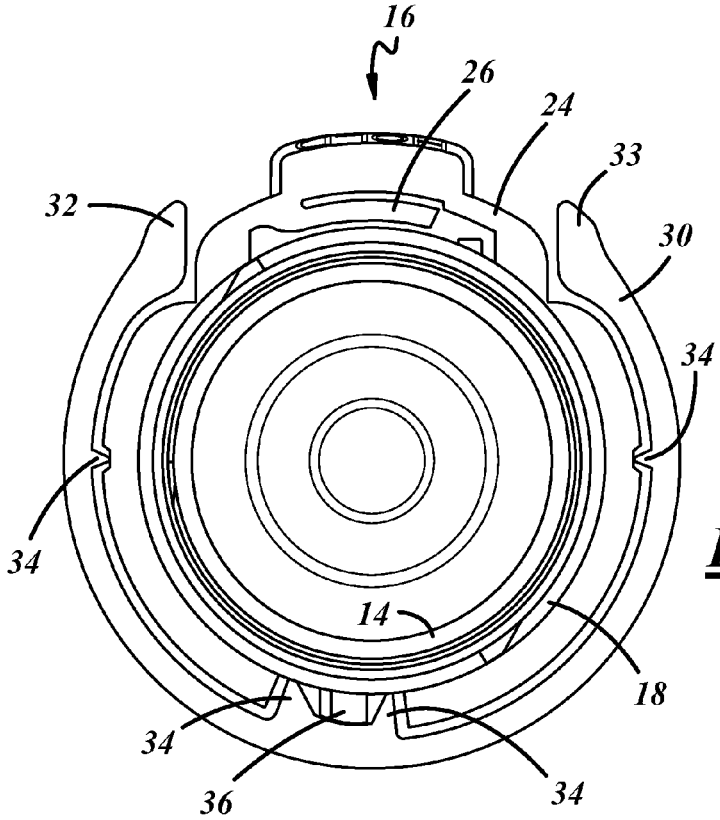
FIG. 2 is a top plan view of the container in the package of FIG. 1.
Figure 3:
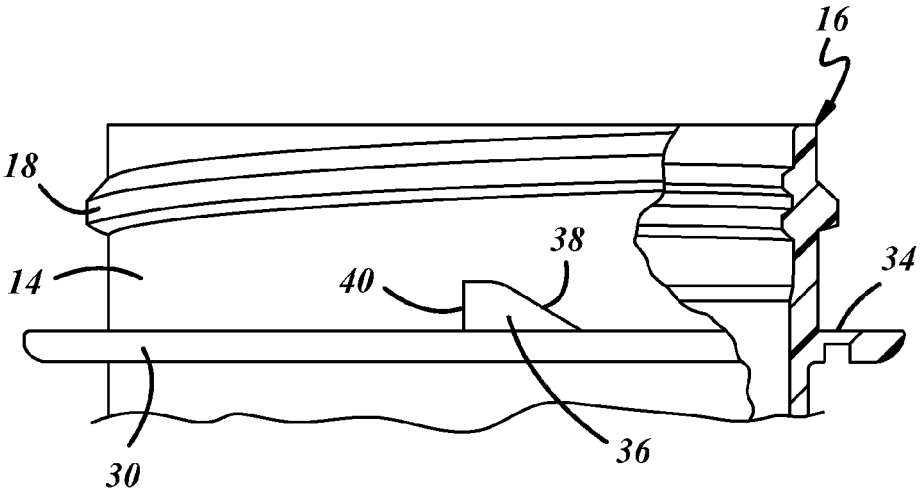
FIG. 3 is a fragmentary partially sectioned elevational view of the container in FIG. 2.

A tear band 30 extends around container finish 14. Tear band 30 preferably is planar and disposed in an arc with spaced ends 32,33 adjacent to release element 24. The plane of tear band 30 preferably is substantially perpendicular to the axis of finish 14. Tear band ends 32,33 preferably are enlarged, as best seen in FIG. 2, to facilitate manual grasping and removal of tear band 30. Tear band 30 is frangibly connected to finish 14 of container 16, preferably by angularly spaced frangible bridges 34. As an alternative, tear band 30 could be connected to the container finish by a frangible web. A locking lug 36 is upstanding from tear band 30, preferably at a position substantially diametrically opposed to release element 24 as best seen in FIG. 2. Locking lug 36 has a counterclockwise-facing angled cam surface 38 (FIG. 3) and a clockwise-facing abutment face 40. It will be noted in FIG. 2 that two of the bridges 34 preferably are disposed adjacent to locking lug 36 on opposite sides of the locking lug. This preferred arrangement provides support to the tear band when locking lug 36 is engaged and deflected during application of the closure to the container.

Closure skirt 22 has a second lock element 42, preferably in the form of an axially facing pocket, that is generally diametrically opposed to first lock element 28. When closure 12 is first applied to container finish 14, the closure skirt rides over cam face 38 of locking lug 36 until locking lug 36 snaps into pocket 42 and lock element 28 engages locking lug 26 on release element 24. Depression of release element 24 disengages lug 26 from lock element 28, but closure 12 cannot be unthreaded because locking lug 36 is in engagement with pocket 42 on closure skirt 22. To release the closure skirt for unthreading, tear band 30 is manually grasped at one or both ends 32,33 and frangibly removed from the container finish. This frangible removal of tear band 30 simultaneously removes locking lug 36 from the container inasmuch as locking lug 36 is carried by tear band 30. With locking lug 36 and tear band 30 so removed from the container, closure 12 can be removed by depression of release element 24 and simultaneous unthreading of the closure from the container finish. Partial or complete fracture of tear band 30 provides indication that the package has been opened.

Container 16, including tear band 30, preferably are of one-piece integrally molded plastic construction and can be molded in any suitable type of molding operation. U.S. patent document 2005/0167889, for example, discloses techniques for making blow molded containers having a finish 14 and a deflectable release element 24, and which can be employed to implement the present disclosure. The container also can be made by injection molding.

There thus have been disclosed a tamper-indicating child-resistant package and a container for such a package that fully satisfy all of the objects and aims previously set forth. The disclosure has been presented in conjunction with an exemplary embodiment, and modifications and variations have been discussed. Other modifications and variations readily will suggest themselves to persons of ordinary skill in the art in view of the foregoing disclosure. The disclosure is intended to embrace all such modifications and variations as fall within the spirit and broad scope of the appended claims.

The invention claimed is:

1. A tamper-indicating child-resistant package that includes:

a container having a cylindrical finish with at least one external thread segment, a manually deflectable release element externally cantilevered from said finish, a tear band frangibly connected to said finish and having an upstanding locking lug generally diametrically opposite from said release element, and a closure having a skirt with at least one internal thread segment for mating engagement with said at least one external thread segment on said finish, a first lock element on said skirt for engagement with said manually deflectable release element and a second lock element on said skirt for engagement with said locking lug on said tear band, engagement between said second lock element and said locking lug on said tear band preventing unthreading of said closure from said finish until said tear band is frangibly removed from said finish, whereupon deflection of said manually deflectable release element releases said closure for unthreading from said finish.

2. The package set forth in claim 1 wherein said tear band is planar, extends partway around said finish and has ends disposed adjacent to said release element.

3. The package set forth in claim 2 wherein said tear band has enlarged tabs at said ends adjacent to said release element.

4. The package set forth in claim 1 wherein said tear band is frangibly connected to said finish by angularly spaced frangible bridges.

5. The package set forth in claim 4 wherein two of said bridges are on opposite sides of said locking lug adjacent to said locking lug.

6. The package set forth in claim 1 wherein said upstanding locking lug has a counterclockwise-facing angled cam face and a clockwise-facing abutment face for engagement with said second lock element.

* * * * *